United States Patent [19]

Tupman

[11] Patent Number: 4,785,601

[45] Date of Patent: Nov. 22, 1988

[54] PLASTER CONTROL SCREED

[75] Inventor: Thomas G. Tupman, Newport Beach, Calif.

[73] Assignee: Fry Reglet Corporation, Alhambra, Calif.

[21] Appl. No.: 66,750

[22] Filed: Jun. 26, 1987

[51] Int. Cl.[4] ..... E04F 13/16

[52] U.S. Cl. ..... 52/364; 52/371; 52/573

[58] Field of Search ..... 52/35, 238.1, 241–243, 52/254, 255, 278, 345–347, 354, 355, 361, 364, 365, 367, 368, 371, 376, 464, 468, 483, 573, 732, 366; 33/518, 565, 404

[56] References Cited

U.S. PATENT DOCUMENTS

| | | | |
|---|---|---|---|
| 2,948,994 | 8/1960 | Thom | 52/278 |
| 3,170,268 | 2/1965 | Balzer et al. | 52/278 |
| 3,192,577 | 7/1965 | Barr | 52/364 |
| 3,331,171 | 7/1967 | Hallock | 52/278 |
| 3,331,176 | 7/1967 | Washam | 52/371 |

FOREIGN PATENT DOCUMENTS

| | | | |
|---|---|---|---|
| 237627 | 3/1960 | Australia | 52/255 |

*Primary Examiner*—John E. Murtagh
*Assistant Examiner*—Andrew Joseph Rudy
*Attorney, Agent, or Firm*—Fred Flam

[57] ABSTRACT

A plaster screed is made of two metal parts of uniform cross-sectional configuration. The two parts overlap, each part providing one of the sides of the channels. The first part provides a laterally projecting attaching flange as well as the channel bottom, the channel bottom being extended beneath the channel side provided by the second part as well as beneath its laterally extending attaching flange. The attaching flange of the second part is stepped so that the bottom of the screed is essentially flat. The area of the step just beyond the terminus of the first part provides a rearwardly facing groove filled with a suitable thermoplastic sealant. The sealant complements the parts to provide a flat base free of moisture traps while allowing slight relative movement between the parts for relieving stress that otherwise would build up in the plaster material.

2 Claims, 1 Drawing Sheet

PLASTER CONTROL SCREED

FIELD OF INVENTION

This invention relates to building construction, and more particularly to a reveal molding for plaster or the like, the molding providing spaced plaster grounds for adjacent wall segments.

BACKGROUND OF THE INVENTION

Reveal moldings for exterior plaster are commonly used. A typical molding comprises an extruded aluminum channel with nailing flanges extending laterally outwardly from the base of the channel. The channel sides provide grounds for the plaster on opposite sides with an atractive separation between them. Additionally, the channel forms a trap interrupting transverse water flow and providing a runoff path.

Plaster has a measurable coefficient of thermal expansion. If the stucco or plaster is confined, the resulting stresses will cause the unsightly cracking. The conventional aluminum molding structure is relatively rigid, and does not adequately yield to the thermal stresses. The obvious solution is to provide a molding structure made of thermoplastic material, perhaps with a partial fold or curve in the channel bottom to allow slight movement. However, plastic moldings soon deteriorate when subjected to sunlight.

An object of the present invention is to provide a metal molding for plaster that yields sufficiently to minimize cracking of plaster. Still another object of this invention is to provide a plaster control screed made of metal that oterhwise conforms to the characteristics of traditional plaster screeds.

SUMMARY OF INVENTION

In order to accomplish the foregoing objectives, I provide a plaster screed made of two metal parts of uniform cross-sectional configuration. The two parts overlap, each part providing one of the side of the channels. The first part provides a laterally projecting attaching flange as well as the channel bottom, the channel bottom being extended beneath the channel side provided by the second part as well as beneath its laterally extending attaching flange. The attaching flange of the second part is stepped to accommodate the companion part whereby the back of the screed is essentially flat. The area of the step just beyond the terminus of the first part provides a rearwardly facing groove filled with a suitable thermoplastic sealant. The sealant complements the parts to provide a flat base free of moisture traps while allowing slight relative movement between the parts. Stress that otherwise would build up in the plaster material is relieved.

BRIEF DESCRIPTION OF THE DRAWINGS

A detailed description of the invention will be made with reference to the accompanying drawings wherein like numerals designate corresponding parts in the several figures. These drawings are to scale.

DETAILED DESCRIPTION OF PREFERRED EMBODIMENT

The following detailed description is of the best presently contemplated mode of carrying out the invention. This description is not to be taken in a limiting sense, but is made merely for purposes of illustrating the general principles of the invention, the scope of the invention being defined by the appended claim or claims.

Figure 2:
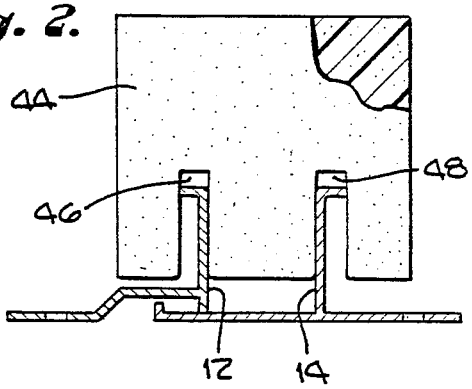
FIG. 2 is an enlarged transverse sectional view of the screed taken along a plane corresponding to line 2—2 of FIG. 1.
Figure 1:
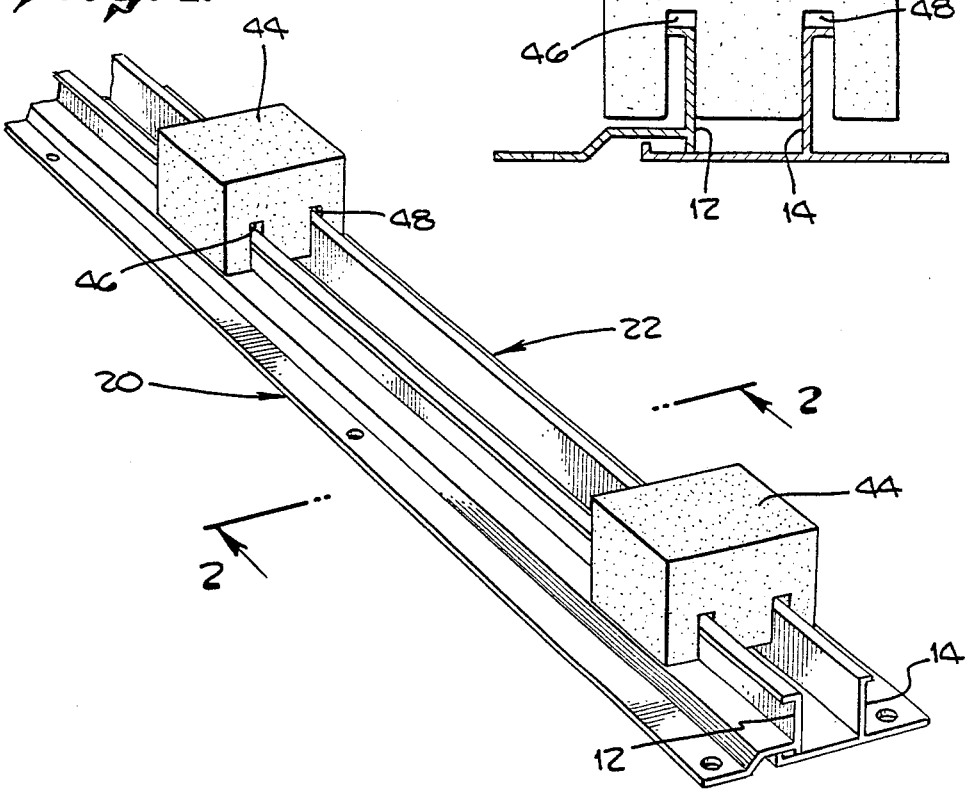
FIG. 1 is a pictorial view of a length of plaster control screed together with styrofoam spacers.
Figure 3:
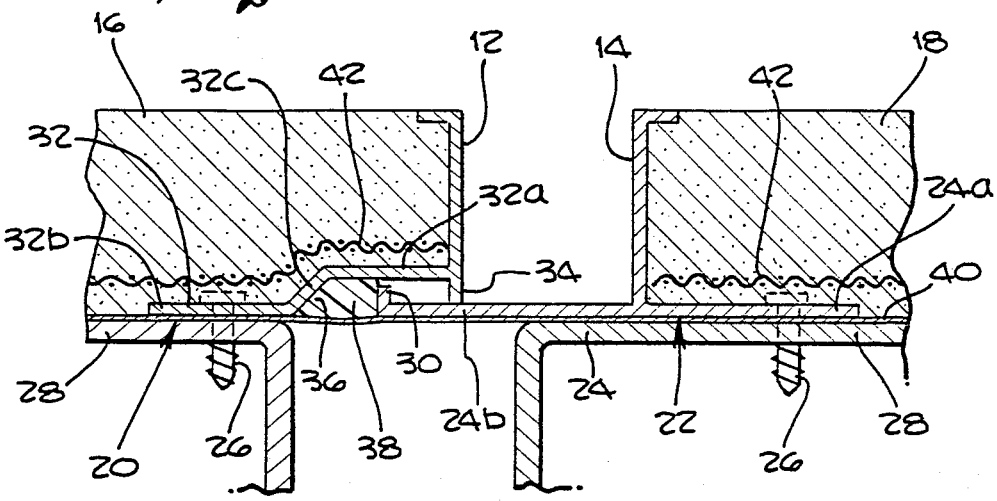
FIG. 3 is a enlarged fragments transverse sectional view showing a typical installation of the screed for an exterior wall structure.

In FIG. 3, there is shown a channel molding, the sides 12 and 14 of which provide grounds for stucco or finish plaster material 16 and 18. The molding is formed of two companion extruded aluminum parts 20 and 22 that respectively provide the channel sides 12 and 14.

The part 22 has a flat base 24. The channel side 14 projects upwardly from the center of the base, dividing it into two portions. One portion **24*a* extends laterally to provide a an attaching flange. Fasteners 26 project through the flange for attachment to a steel stud 28 or other structure. The other portion 24*b* of the base forms the bottom of the channel, and projects beneath and beyond the channel side 12 of the companion part, the portion 24*b* terminating at a short upstanding lip 30**.

The companion part 20 has a base 32 provided with a step **32*c* that divides the base into two portions, one of the base portions being a mortise portion 32*a* that fully accommodates the companion base part 24*b*. This portion 32*a* joins the channel side 12 at a place spaced slightly from its bottom so that a foot 34 is formed on the channel side 12. The foot 34 compensates for the height of the lip 30**.

The outer portion **32*b* of the part 20 provides an attachment flange that is coplanar with the base 24 of the companion part 22. The step 32*c* between the portions 32*a* and 32*b* and the lip 30 together form a groove 36 filled with a suitable thermoplastic and adhesive sealant 38. The height of the lip 30 is designed to provide a groove depth sufficient to accommodate a significant amount of sealant. The sealant 38 fills the groove to be flush with the base portion 32*b* and the base 24 of the part 22**. A flat continuous plate for attachment to the building structure is provided. No groove remains for collection of moisture.

The sealant not only joins the parts 20 and 22 together, but is sufficiently elastic so as to permit slight relative lateral movement of the screed parts whereby thermal stresses in the plaster is relieved. The lip 30 and foot 34 provide mutual support as the parts move slightly. The sealant may be applied in the field: however, it is more conveniently applied at a factory location.

The improved screed is applied in precisely the same manner as a conventional one piece metal screed. Building paper 40 and lath materials 42 are used (FIG. 3) in accordance with standard practice. The builder, however, does not remove styrofoam spacers 44 that are placed along the screed until after the screed is firmly attached to the wall structure. The spacers 44 have relatively deep parallel slots 46 and 48 that receive the sides 12 and 14 of the screed channel. The spacers 44 hold the screed parts 20 and 22 in proper position, and relieve the sealant of that burden. Additionally, the spacers prevent the sealant from breaking away from the screed parts.

Intending to claim all novel, useful and unobvious features and combinations of features shown and/or described, I claim:

1. A plaster control screed of channel configuration comprising two separate metal parts each having a uniform cross-sectional configuration;

(a) the first of said metal parts having a base and a channel side projecting upwardly from the central portion of the base, said channel side dividing the base into two contiguous portions on opposite sides of the channel side respectively, the first of said base portions forming an attaching flange, the second of said base portions forming a channel bottom element, said channel bottom element having a free end;

(b) the second of said metal parts having an offset base formed by a step dividing said offset base into two contiguous portions, one of said two portions being a mortise portion receiving the said channel bottom element with said free end spaced from said step to form a groove, the other of said two portions forming an attaching flange, said second of said metal parts having a channel side, said mortise portion having a terminus at said channel side, said channel side projecting upwardly from said mortise portion terminus; and (c) thermoplastic sealing material in said groove and adhering to both of said metal parts, said sealing material complementing said base of said first metal part and said base of said second metal part to form a substantially flat attachment to a wall structure or the like and that is elastic whereby thermal stresses in the applied plaster material are relieved by slight relative lateral movement of the said metal parts as said channel sides move towards and away from each other.

2. The plaster control screed as set forth in claim 1 in which the said free end of said channel bottom element has a lip to define a groove depth to accommodate a sufficient amount of sealing material; the said channel side of said second metal part having a foot to compensate for the height of said lip whereby said metal parts are mutually supported during lateral movement therebetween.

* * * * *